US008196640B1

(12) United States Patent
Paulus et al.

(10) Patent No.: US 8,196,640 B1
(45) Date of Patent: Jun. 12, 2012

(54) SELF SUPPORTING CORE-IN-A-CORE FOR CASTING

(75) Inventors: John R. Paulus, Afton, VA (US); Michael P. Appleby, Crozet, VA (US)

(73) Assignee: Mikro Systems, Inc., Charlottesville, VA (US)

( * ) Notice: Subject to any disclaimer, the term of this patent is extended or adjusted under 35 U.S.C. 154(b) by 0 days.

(21) Appl. No.: 13/382,325

(22) PCT Filed: Jul. 1, 2011

(86) PCT No.: PCT/US2011/042789
§ 371 (c)(1), (2), (4) Date: Feb. 21, 2012

(87) PCT Pub. No.: WO2012/003439
PCT Pub. Date: Jan. 5, 2012

(51) Int. Cl.
*B22C 9/04* (2006.01)
*B22C 9/10* (2006.01)

(52) U.S. Cl. ..... 164/34; 164/45; 164/246; 164/369; 164/516

(58) Field of Classification Search ..... 164/34, 164/45, 246, 369, 516
See application file for complete search history.

(56) References Cited

U.S. PATENT DOCUMENTS

| | | | |
|---|---|---|---|
| 3,196,506 | A | 7/1965 | Operhall |
| 3,296,666 | A | 10/1967 | Lirones |
| 3,610,314 | A | 10/1971 | Hochgraf |
| 4,986,333 | A | 1/1991 | Gartland |
| 5,394,932 | A | 3/1995 | Carozza |
| 5,498,132 | A | 3/1996 | Carozza |
| 5,505,250 | A | 4/1996 | Jago |
| 6,347,660 | B1 | 2/2002 | Sikkenga |
| 6,533,986 | B1 | 3/2003 | Fosaaen |
| 6,588,484 | B1 | 7/2003 | Fosaaen |
| 6,626,230 | B1 | 9/2003 | Woodrum |
| 6,720,028 | B1 | 4/2004 | Haaland |
| 6,932,145 | B2 | 8/2005 | Frasier |
| 7,153,096 | B2 | 12/2006 | Thompson |
| 7,247,002 | B2 | 7/2007 | Albrecht |
| 2003/0075301 | A1 | 4/2003 | Kimbrough |
| 2005/0205229 | A1 | 9/2005 | Jiang |

FOREIGN PATENT DOCUMENTS

| | | |
|---|---|---|
| GB | 14141 | 0/1909 |

*Primary Examiner* — Kuang Lin
(74) *Attorney, Agent, or Firm* — David G. Maire; Beusse Wolter Sanks Mora & Maire, P.A.

(57) ABSTRACT

A core-in-a-core casting method and hybrid core (40) for use in the method. An inner core (42) formed of process-inert particles disposed in a binder material is used as a mold for casting an outer core ((44) formed of particles that will sinter during a subsequent firing step. The inner core provides mechanical support for the outer core during the firing step, and during which the inner core devolves into compacted but unbonded particles that can be removed conveniently from the outer core following the firing step to reveal the fired hollow outer core (44).

13 Claims, 5 Drawing Sheets

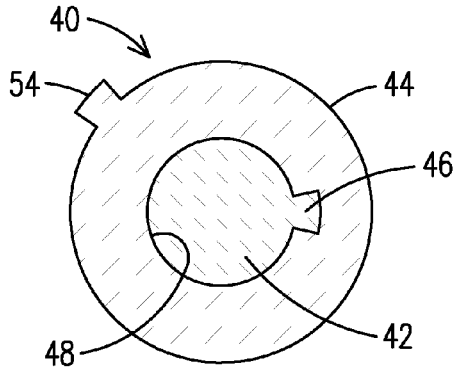
FIG. 6
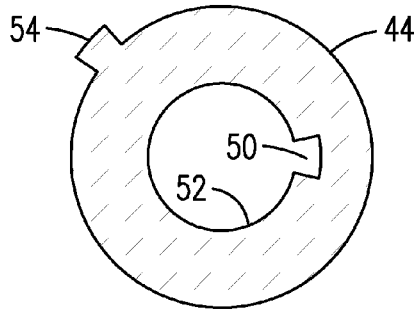
FIG. 7
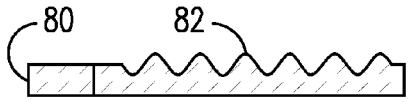
FIG. 8A
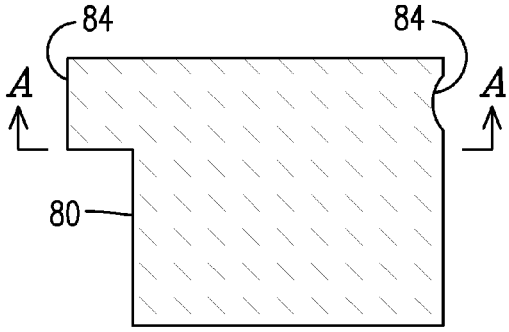
FIG. 8B
FIG. 9A
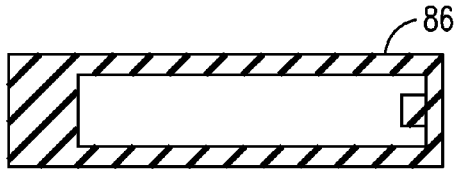
FIG. 9B
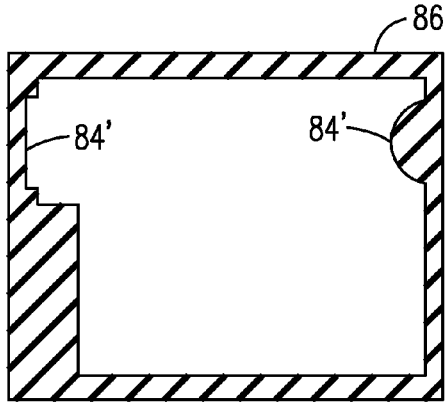

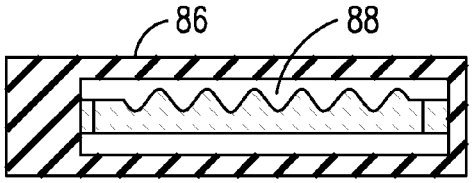
FIG. 10A
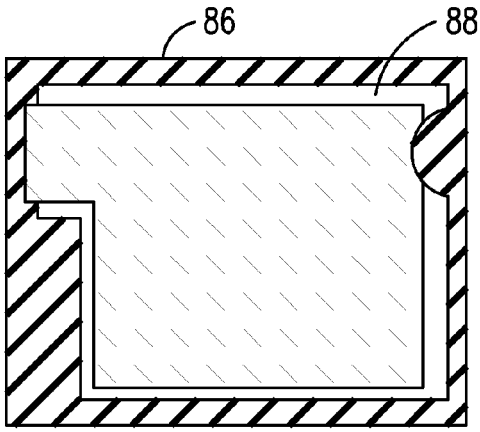
FIG. 10B
FIG. 11A
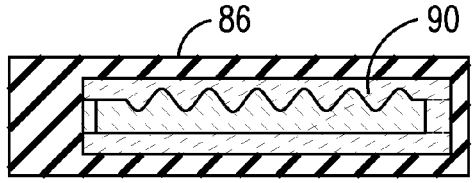
FIG. 11B
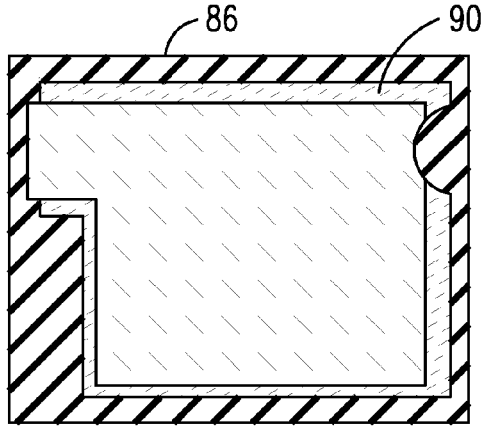

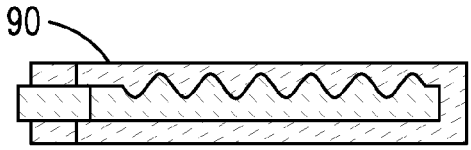
FIG. 12A
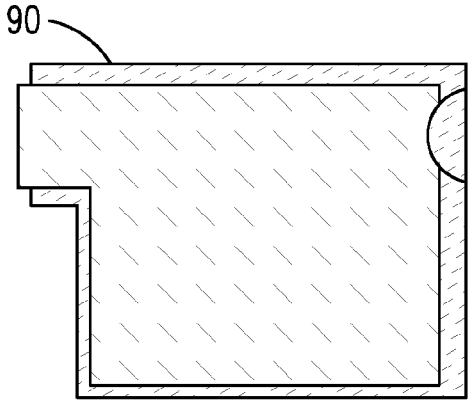
FIG. 12B
FIG. 13A
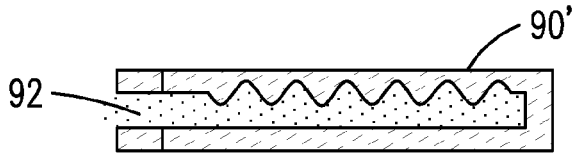
FIG. 13B
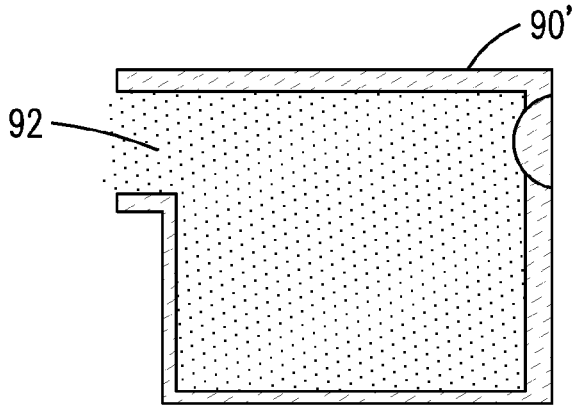

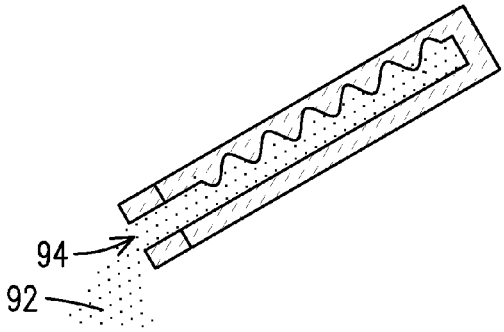
FIG. 14A
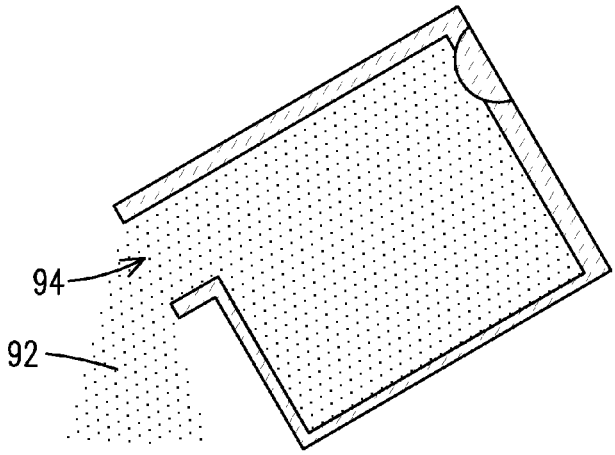
FIG. 14B
FIG. 15A
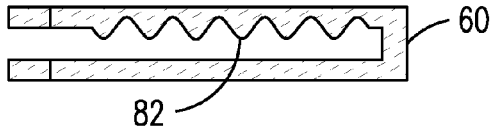
FIG. 15B
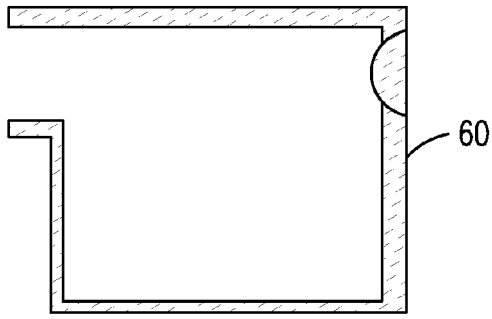

SELF SUPPORTING CORE-IN-A-CORE FOR CASTING

FIELD OF THE INVENTION

This invention relates generally to the field of investment casting, and more particularly to ceramic cores used in a metal alloy casting process.

BACKGROUND OF THE INVENTION

Investment casting is one of the oldest known metal-forming processes, dating back thousands of years to when it was first used to produce detailed artwork from metals such as copper, bronze and gold. Industrial investment castings became more common in the 1940's when World War II increased the demand for precisely dimensioned parts formed of specialized metal alloys. Today, investment casting is commonly used in the aerospace and power industries to produce gas turbine components such as airfoils having complex outer surface shapes and internal cooling passage geometries.

The production of a component using the prior art lost wax investment casting process involves producing a ceramic casting vessel including an outer ceramic shell having an inside surface corresponding to the desired outer surface shape of the component, and one or more ceramic cores positioned within the outer ceramic shell corresponding to hollow interior passages to be formed within the component. Molten metal alloy is introduced into the ceramic casting vessel and is then allowed to cool and to solidify. The outer ceramic shell and ceramic core(s) are then removed by mechanical or chemical means to reveal the cast component having the desired external shape and hollow interior volume (s) in the shape of the ceramic core(s).

Certain component designs may include a dual wall structure wherein two regions of metal are separated by a hollow space, as may commonly be used for internally cooled hot gas path components of a gas turbine engine. FIG. 1 illustrates this concept for a simple rod-in-a-tube component 10, although one skilled in the art will recognize the application of this concept to more complex structures where the inner structure has a more planar geometry, such as is often used for internally cooled gas turbine hot gas path components. In cross-section, component 10 includes an outer tube wall 12 encircling an inner rod (wall) 14, thereby defining an open volume 16 there between. The metal alloy component 10 may be cast using a hollow ceramic core 20, as illustrated in FIG. 2. The ceramic core 20 defines the shape of the open volume 16 when the component 10 is cast within an outer casting shell (not shown).

It is known to form the hollow ceramic core 20 of FIG. 2 by first producing a consumable preform 22, as shown in cross-section in FIG. 3, which is formed of wax. The wax preform 22 is then placed into a mold 24 and ceramic slurry 26 is injected around the preform 22. The ceramic slurry 26 is dried to a green state and then removed from the mold 24 and placed into a furnace for firing of the green body to form the ceramic core 20. The green body may be externally mechanically supported within the furnace by a packing material during the firing process. Such packing material may be a ceramic powder which is not subject to sintering during the firing sequence. The wax preform 22 will melt early in the firing sequence and will puddle, and it will eventually volatize and be removed from the furnace as a gas. It is known that such hollow ceramic molds 20 are often difficult to produce and subject to distortion, breakage and low yields because the green body strength of the dried but unfired ceramic slurry 26 is low, and it remains unsupported on its interior surface 28 once the wax preform 22 melts. Prior to the wax melting, there may be deleterious differential thermal expansion forces imposed on the green body due to the different coefficients of thermal expansion of the wax and ceramic materials.

Accordingly, an improved process for forming dual-walled and hollow cast metal components is desired.

BRIEF DESCRIPTION OF THE DRAWINGS

The invention is explained in the following description in view of the drawings that show:

FIG. 6 is a cross sectional view of a ceramic core in accordance with another embodiment of the invention including an engineered surface feature.

FIG. 7 is a cross sectional view of the outer ceramic body of the ceramic core of FIG. 6 after a firing process.

FIGS. 8A/8B through 15A/15B are schematic illustrations of a process of forming a ceramic part including interior engineered surface features.

DETAILED DESCRIPTION OF THE INVENTION

Figure 1:
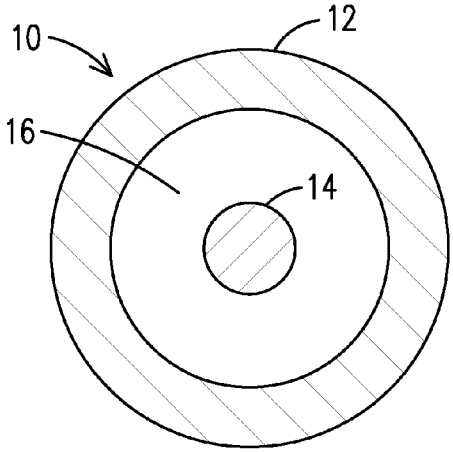
FIG. 1 PRIOR ART
FIG. 1 is a cross sectional view of a prior art dual walled component.
Figure 2:
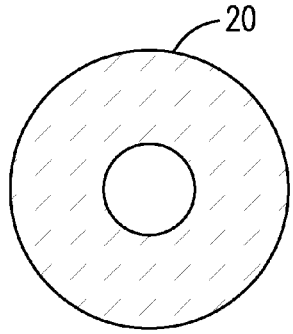
FIG. 2 PRIOR ART
FIG. 2 is a cross sectional view of a prior art ceramic core used for casting the component of FIG. 1.
Figure 3:
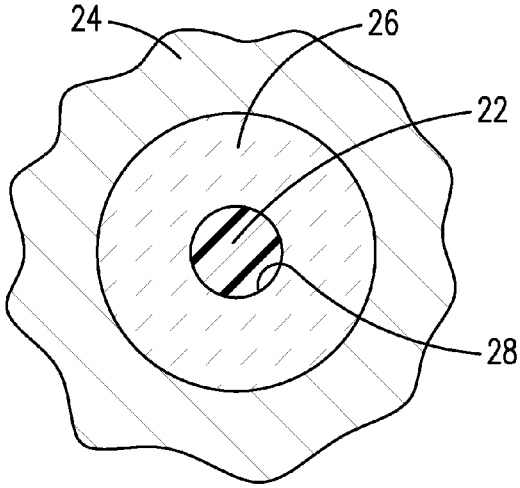
FIG. 3 PRIOR ART
FIG. 3 is a cross sectional view of a wax preform disposed within a mold during a ceramic slurry casting process as may be used to form the ceramic core of FIG. 2.
Figure 4:
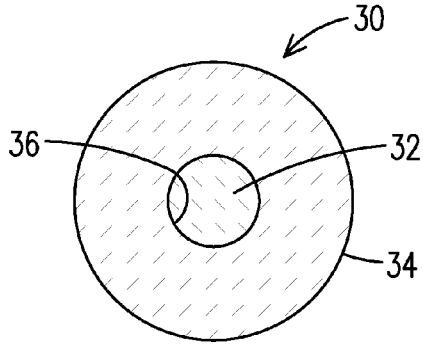
FIG. 4 is a cross sectional view of a ceramic core in accordance with an embodiment of the invention.

The present invention overcomes the problems associated with prior art investment casting of dual-walled components by utilizing a hybrid core 30 incorporating a core-in-a-core structure as illustrated in cross section for one embodiment in FIG. 4. The core 30 includes an inner body 32 and an outer body 34. The inner body 32 may be formed of a material including first ceramic particles disposed in a first binder material. The outer body 34 may be formed of a material including second ceramic particles disposed in a second binder material. In some embodiments, non-ceramic particles may be used for either or both of the inner and outer bodies 32, 34, such as powdered metals or carbides (for example, silicon carbide); however, for the purposes of illustration below, the inner body 32 will be referred to as an inner ceramic body 32 and the outer body 34 will be referred to as an outer ceramic body 34. The inner ceramic body 32 is formed first and is at least partially cured so that its outer surface defines a mold surface 36 for the casting of the outer ceramic body 34. The inner ceramic body 32 is placed in a casting die (not shown) to define a casting volume there between, and a ceramic slurry containing the second ceramic particles and the second binder material is poured into the casting volume to cast the outer ceramic core 34 around the inner ceramic core 32. The slurry is then dried/cured to a green state, and the hybrid core-in-a-core ceramic core 30 is removed from the casting die and placed in a firing furnace (not shown) for firing. As is known in the art, the green body may be externally mechanically supported within the furnace by a non-sintering packing material during the firing process. Unlike the prior art, the inner ceramic core 32 also provides mechanical support for the outer ceramic core 34 at the inner mold surface 36 during the firing regiment, as described more fully below.

The materials of construction of the core 30 are specifically selected to work in cooperation with the casting and firing processes to provide a core for dual wall applications which not only overcomes known problems with prior art cores, but also provides additional design capability and process variable control previously unknown in the art. For the example of a composite ceramic core, the first and second ceramic particles and the first and second binder materials, of the inner ceramic body 32 and outer ceramic body 34 respectively, exhibit respective properties such that during a firing regiment effective to volatize the second binder material and to sinter the second ceramic particles, the first binder material is volatized but the first ceramic particles are not sintered. For example, the first ceramic particles may include zircon or alumina and the second ceramic particles may include silica, and the firing regiment may be adequate to sinter the silica particles but not to sinter the zircon or alumina particles. The first and second binder materials may be the same or different materials, and they may have the same or different volatilization temperatures, for example, the first binder material may be a polymer exhibiting a first volatilization temperature of about 250° F. while the second binder material may be a polymer exhibiting a second volatilization temperature of about 300° F.

Figure 5:
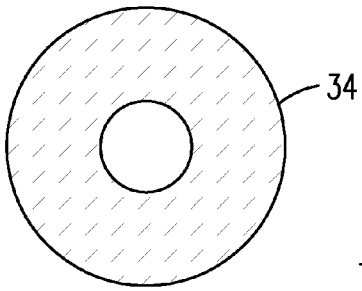
FIG. 5 is a cross sectional view of the outer ceramic body of the ceramic core of FIG. 4 after a firing process.

The materials and processes of the present invention result in an outer ceramic body 34 which is suitable for use in a conventional metal alloy casting process. Advantageously, throughout the firing regiment the inner ceramic body 32 retains its structure and acts to mechanically support the outer ceramic body 34 as the outer ceramic body begins to sinter and to gain strength and structural stability. However, because the first ceramic particles of the inner ceramic body 32 do not sinter during the firing regiment, when the first binder material of the inner ceramic body 32 is volatized, the first ceramic particles devolve into unbonded ceramic particles. The unbonded ceramic particles remain tightly packed against the surface of the outer body 34 even after the first binder material is volatized because the outer body 34 encompasses the inner body 32, thereby retaining the ceramic particles in a packed condition and providing internal support for the outer body 34. While the binder functions to provide tensile strength to the body, it is the interaction between the particles themselves that provides compressive strength to the inner body even when the binder is absent. In this regard, the unbonded but packed particles function as a packing material similar to the packing material that is used on the outer surface of the core 30 during the firing operation. Once the fired core is removed from the furnace, the unbonded particles can be removed easily from within the outer ceramic body 34, leaving it as shown in FIG. 5 and ready for use in a subsequent metal casting process.

It will be appreciated that the particles selected for the inner body may be "process-inert", which as used herein means that the particles do not change their chemical composition or structure and that they do not chemically react with adjoining materials during the time in which they are used as part of the inventive process. The process-inert particles do not sinter and they do not change their properties over the range of temperatures and the range of exposures to other materials as they are included in the slurry for the inner body, exposed to drying and partial firing conditions for the inner body, used as a mold surface for the outer body slurry, exposed to drying and firing conditions for the outer body, and eventually removed from the outer body as unbonded particles.

The assignee of the present invention has developed a number of polymer-based ceramic core molding materials which provide improved green body strength when compared to previous ceramic core molding materials. Such improved ceramic core molding materials are described in pending International Patent Application PCT/US2009/58220 incorporated by reference herein. That application describes a ceramic molding composition that mimics previous ceramic core molding materials in its fully sintered condition, but that provides significantly improved green body strength when compared to the previous materials. A ceramic casting material such as described in the above-cited International Patent Application PCT/US2009/58220 exhibits a lower viscosity than prior art ceramic core casting materials, thereby allowing the casting of the slurry to be performed at low pressure, such as at 10-15 psi. In contrast, prior art ceramic core material injection is typically performed at pressures an order of magnitude higher.

In one embodiment of the present invention, the ceramic casting material used for the outer ceramic body may be one of the materials described in International Patent Application PCT/US2009/58220, and may include epoxy in a range from 28 weight % in a silica based slurry to as low as 3 weight %. The silicone resin of the composition may be a commercially available material such as sold under the names Momentive SR355 or Dow 255. This content could range from 3 weight % to as high as 30 weight %. The mix may use 200 mesh silica or even more coarse grains. Solvent content generally goes up as other resins decrease to allow for a castable slurry. The solvent is used to dissolve the silicon resin and blend with the epoxy without a lot of thermal energy, therefore at a relatively low temperature. The Modulus of Rupture (MOR) of the sintered material is on the norm for fired silica, typically 1500-1800 psi with 10% cristobalite on a 3 point test rig. The sintered material MOR is tightly correlated to the cristobalite content, with more cristobalite yielding weaker room temperature strength. The green state MOR depends on the temperature used to cure the epoxy, as it is a high temperature thermo cure system. The curing temperature may be selected to allow for some thermo-forming, i.e. reheating the green state material to above a reversion temperature of the epoxy to soften the material, then bending it from its as-cast shape to a different shape desired for subsequent use. Following such thermo-forming or in the absence of it, additional curing may be used to add strength. In one embodiment the Modulus of Rupture achieved was:

MOR cured at 110° C. for 3 hours=4000 psi

MOR cured as above and then at 120° C. for 1 hour=8000 psi.

A 10% as-fired cristobalite content may be targeted. This may be altered by the mineralizers present and the firing schedule. The 10% initial cristobalite content may be used to create a crystalline seed structure throughout the part to assure that most of the rest of the silica converts to cristobalite in a timely fashion when the core is heated prior to pouring molten metal into the ceramic mold. It also keeps the silica from continuing to sinter into itself as it heats up again.

The composition of the inner body 32 may also be based upon particles held in a binder matrix. The particles are selected to provide a desired strength, density and size distribution. The binder material may be any material providing a desired degree of strength in its green body stage, yet becoming fugitive and escaping as a gas during the firing of the outer body 34. Thus, the materials and properties of the inner body 32 are different than the materials and properties of the outer body 34, and the inner body 32 functions not only as a mold for the outer body 34, but also as a mechanical support for the outer body 34 during the firing regiment, thereby reducing slumping or other distortion of the outer body 34.

The following are among the advantages of the present invention:

Because both the inner and outer bodies 32, 34 are powder and polymer based, their coefficients of thermal expansion will be much more closely matched with each other than with that of wax, thereby minimizing the differential thermal expansion forces imposed there between during processing.

The inner and outer bodies 32, 34 contain materials which are fully compatible and are non-reactive with each other during processing. The use of a prior art wax preform would preclude the use of epoxy based ceramic slurry for the outer ceramic body because the wax and epoxy would chemically react with each other. Other polymers such as urethane, acrylics, etc. may be used as the fugitive binder material.

Because the green state inner body 32 will remain solid at a much higher temperature than would a wax preform, the casting temperature of the slurry used for the outer body 34 may be much higher than would otherwise be possible with a wax preform.

FIGS. 6 and 7 illustrate in cross section another embodiment of the invention. A ceramic core 40 is formed of an inner ceramic body 42 and an outer ceramic body 44 formed as discussed above with respect to the composite ceramic core 30 of FIG. 4. In this embodiment, an engineered surface feature such as ridge 46 is formed on the outer mold surface 48 of the inner ceramic body 42, and a resulting notch 50, which is a reverse of the ridge 46, is thereby formed on the inner surface 52 of the outer ceramic body 44. One skilled in the art will appreciate that the term "engineered surface feature" may include a variety of shapes selected by the designer and purposefully formed on the mold surface 48, and it excludes normal surface roughness or irregularities associated with normal fabrication processes, and it is expressly distinct from the general contour of the mold surface 48 apart from the engineered surface feature, whether that general contour is flat or curved. The engineered surface features envisioned herein may include, but are not necessarily limited to: protrusions, depressions, and undercuts; linear and curvilinear surfaces which vary from the general contour, and combinations thereof; shapes having three or more sides in cross section; shapes continuous or tapered in cross section along a longitudinal axis; shapes designed to accommodate a mating shape of a cooperating part; and shapes designed to affect a fluid passing over the surface. It may be appreciated that the characteristics of the powders and binders selected for a particular body may be chosen with consideration given to the requirements of an engineered surface feature on the body. For example, relatively smaller engineered surface features may require the use of a relatively finer particle size range in order to obtain the required surface resolution and also to allow for the free release of the loose particles upon completion of the firing step. In addition to particle size range, the particle weight, shape, mechanical properties, and packing fraction may also be controlled as design variables to achieve desired characteristics in the inner and outer bodies.

An engineered surface feature such as ridge 54 may also be formed on an outside surface of the outer body 44 by forming the negative of such feature on the inside surface of the casting vessel (not shown) used to cast the outer body 44 around the inner body 42. Such a feature 54 may be useful as a printout for locating and/or supporting the outer body 44 during its later use in a metal casting operation. The relative locations of the inner surface feature 50 and the outer surface feature 54 may be indexed to ensure precise location of an internal feature in the resulting cast metal part.

FIGS. 8A/8B through 15A/15B illustrates the steps of forming a part 60 in accordance with one embodiment of the present invention. Part 60 includes a hollow center region defined by an interior surface which includes engineered surface features 82.

As described in the Background of the Invention, the use of prior art wax-based processes to produce part 60 of FIG. 15B would subject the part to distortion and loss of dimensional tolerance because the part would remain unsupported on its interior surface as the wax preform defining the interior dimensions of the part melts during the sintering step. Furthermore, prior to the wax melting, there may be deleterious differential thermal expansion forces imposed on the green body part due to the different coefficients of thermal expansion of the wax and ceramic materials.

FIG. 8A is a side sectional view of a casting of an inner body 80 which is formed of process-inert particles disposed in a first binder material, as described above with respect to FIG. 4 or 6. FIG. 8B is the same inner body 80 as seen in a top sectional view, with FIG. 8A taken along the line A-A of FIG. 8B. FIGS. 9A/9B through 15A/15B are similarly related to each other with the "A" figure for a given number taken along a corresponding section of the "B" figure for that same number. The inner body 80 may be formed to include engineered surface feature(s) 82 and/or alignment feature(s) 84 as desired. Inner body 80 is cast using known casting techniques in a casting mold (not shown) and is dried and cured to a green state as shown in FIG. 8A/8B. One will appreciate that the shape of the inner body 80, including the engineered surface features 82, correspond to a desired interior void shape in the final cast part 60 which is shown in FIG. 15A/15B.

A mold 86 is then formed, as shown in FIG. 9A/9B, to define the shape of the exterior of part 60. Alignment feature (s) 84' may be formed on the mold 86 which correspond to the alignment feature(s) 84 of the inner body 80 such that the inner body 80 may be accurately positioned within the mold 86, as shown in FIG. 10A/10B. The space 88 between the mold 86 and the inner body 80 corresponds to a desired shape of part 60.

An outer body 90 is then cast into space 88 between the mold 86 and inner body 80, as shown in FIG. 11A/11B. The outer body 90 may include second particles disposed in a second binder material. Unlike the process-inert particles of the inner body 80, the second particles of the outer body 90 are selected to be sinterable in a later firing process.

Once the outer body 90 is dried and cured to a green state, the mold 86 is removed as shown in FIG. 12A/12B to reveal an unfired hybrid cast part 90. The mold 86 may be formed of a flexible material if desired in order to accommodate its removal from around the outer body 90, such as in the process described in commonly assigned U.S. Pat. No. 7,141,812.

The unfired hybrid cast part 90 is then subjected to a firing regiment wherein the first and second binder materials become fugitive, the second particles sinter, but the process-inert particles do not sinter. In the post-fired condition, as shown in FIG. 13A/13B, the fired outer body 90' is now filled with unbonded process-inert particles 92 which remain compacted together due to the encapsulating action of the surrounding outer body 90'. Conversely and importantly, the outer body 90, 90' is mechanically supported throughout the firing process by the process-inert particles 92 as the second particles sinter and as the relatively weak green outer body 90 gradually transforms into a relatively strong fired outer body 90'. During this firing step, the outer body 90, 90' may also be supported on its exterior by a packing material (not shown) as is known in the art.

Once the outer body 90' is fully fired and cooled, the unbonded process-inert particles 92 are removed from within the outer body 90' through an existing or newly created opening 94 in the wall of the outer body 90' as shown in FIG. 14A/14B, to reveal the final fired part 60 as shown in FIG. 15A/15B. Any remnant of the unsintered process-inert particles 92 that may remain within the outer body 90', as shown in the photograph of FIG. 16, may be dislodged by gentle agitation, mechanical scraping, fluid flushing, etc. The fully fired part 60 may be used as a core for a subsequent alloy casting process wherein the engineered surface feature(s) 82 are then transferred onto an interior wall surface of a cast metal part.

The present invention may be particularly useful for forming near-wall cooling passages in thin, actively-cooled, metal components, such as the trailing edge section of a gas turbine airfoil. As gas turbine firing temperatures continue to increase and airfoil designs continue to be optimized to improve the efficiency of modern gas turbine engines, the ability to manufacture ever smaller and more precisely defined subsurface cooling channels features into such thin walled structures has become a design limitation due to difficulties in maintaining the necessary tight tolerances during the casting process. The present invention allows for the production of very high precision ceramic cores for such castings, enabling geometries and tolerances that are unachievable using prior art processes.

One example of a process that can yield high resolution features or detail is tomo lithographic molding, a process which is available from the assignee of the present invention and is described in U.S. Pat. Nos. 7,411,204; 7,410,606; and 7,141,812 and U.S. Patent Application Publication Nos. 2004/01566478, 2008/0053638 and 2009/0084933, each of which is incorporated herein by reference. Tomo lithographic molding can provide greater geometric and dimensional control with respect to high resolution features compared to conventional core formation processes. That capability can be synergistically combined with the present invention to produce metallic parts with heretofore unachievable internal passageway geometries and tolerances. To produce thin-wall metallic parts with close subsurface cooling channels, it is critical to hold tight those tolerances which affect wall thickness, otherwise the resulting part may be too weak or the resulting cooling passage may be ineffective. Tomo lithographic molding enables the creation of such high precision geometric features on a surface, and the present invention maintains the dimensional fidelity achieved by the tomo lithographic molding through the sintering step for designs which require a hollow ceramic core.

Without the present invention, it was necessary in the prior art to produce some ceramic core designs in two or more pieces which were then joined together prior to the metal casting step. In addition to being more expensive, multiple piece ceramic cores include joints which reduce dimensional precision, and they require additional handling which increases the potential for damage and lower yields. For example, in order to avoid the problems associated with a center wax perform, the ceramic part 60 of FIG. 15A may have been produced in the prior art in two pieces, a top piece including the engineered surface features 68 and a bottom piece which would later be joined to the bottom piece. Now it is possible by combining tomo lithographic molding with the present invention to produce part 60 as a single integral structure which maintains the fidelity of the tomo lithographic features on its interior with the same tolerance as can be maintained on an exterior surface.

While various embodiments of the present invention have been shown and described herein, it will be obvious that such embodiments are provided by way of example only. Numerous variations, changes and substitutions may be made without departing from the invention herein.

The invention claimed is:

1. An apparatus comprising:

an inner ceramic body comprising first ceramic particles disposed in a first binder material, the inner ceramic body in a green state defining a mold surface for an outer ceramic body cast over the green body inner ceramic body;

the outer ceramic body comprising second ceramic particles disposed in a second binder material;

wherein the first and second ceramic particles and the first and second binder materials are selected to exhibit respective properties such that during a firing regiment the first and second binder materials become fugitive and the second ceramic particles sinter but the first ceramic particles do not sinter.

2. The apparatus of 1, wherein the first ceramic particles comprise zircon or alumina.

3. The apparatus of 1, wherein the first binder material comprises a polymer exhibiting a first volatilization temperature and the second binder material comprises a polymer exhibiting a second volatilization temperature different than the first volatilization temperature.

4. The apparatus of 1, further comprising an engineered surface feature formed on the inner ceramic body mold surface and reflected in reverse in an opposed inner surface of the outer ceramic body.

5. The apparatus of 4, further comprising an engineered surface feature formed on an outer surface of the outer ceramic body.

6. The apparatus of 1, further comprising an engineered surface feature formed on an outer surface of the outer ceramic body.

7. The apparatus of claim 1, wherein the first and second binder materials are the same type of material.

8. A method of forming a core for a casting process, the method comprising:

forming an inner body comprising first particles disposed in a first binder material;

casting an outer body comprising second particles disposed in a second binder material onto a surface of the inner body;

firing the outer body using a firing regiment effective to volatize the first and second binder material and to sinter the second particles without sintering the first particles, such that the first particles provide mechanical support for the outer body during the firing regiment even after devolving into unbonded particles when the first binder material volatizes; and removing the unbonded ceramic particles from the fired outer body.

9. The method of 8, wherein the step of forming the inner body further comprises:

forming an inner body die comprising an inner body die surface, the inner body die surface comprising an engineered surface feature;

casting the inner body onto the inner body die surface to replicate a reverse of the engineered surface feature onto the inner body surface; and removing the inner body from the inner body die to reveal the reverse of the engineered surface feature.

10. The method of 9, further comprising:

forming the inner body die of a flexible material; and deforming the flexible material around an undercut surface of the engineered surface feature during the step of removing the inner body from the inner body die.

11. The method of 9, further comprising selecting the first particles in response to a design geometry of the engineered surface feature.

12. The method of 8, further comprising selecting the first particles in response to a design geometry of the inner body.

13. A method of forming a core for a casting process, the method comprising: forming an inner body comprising first particles disposed in a first binder material using a tomo lithographic molding process to define an engineered surface on an outer surface of the inner body;

casting an outer body comprising second particles disposed in a second binder material onto the outer surface of the inner ceramic body, thereby replicating the engineered surface feature on an inside surface of the outer body;

firing the outer body using a firing regiment effective to volatize the first and second binder material and to sinter the second particles without sintering the first particles, such that the first particles provide mechanical support for the outer body during the firing regiment even after devolving into unbonded particles when the first binder material volatizes; and removing the unbonded ceramic particles from the fired outer body to reveal an inner cavity having the engineered surface feature on its surface.

* * * * *